United States Patent [19]

Antonious

[11] 4,042,977

[45] Aug. 23, 1977

[54] GLOVE

[76] Inventor: Anthony J. Antonious, 7005 Lachlan Circle, Baltimore, Md. 21239

[21] Appl. No.: 602,709

[22] Filed: Aug. 7, 1975

[51] Int. Cl.[2] ..... A41D 19/00

[52] U.S. Cl. ..... 2/161 A

[58] Field of Search ..... 2/161 A, 161 R, 159, 2/162

[56] References Cited

U.S. PATENT DOCUMENTS

| | | | |
|---|---|---|---|
| 1,106,708 | 8/1914 | Hazard | 2/159 |
| 3,372,401 | 3/1968 | Woodward | 2/159 |
| 3,504,379 | 4/1970 | Glick | 2/161 A |
| 3,588,917 | 6/1971 | Antonious | 2/161 A |

*Primary Examiner*—Werner H. Schroeder
*Assistant Examiner*—Peter Nerbun
*Attorney, Agent, or Firm*—Sughrue, Rothwell, Mion, Zinn and Macpeak

[57] ABSTRACT

A glove which utilizes a strap or straps attached to the back of the glove near the base of the thumb to maintain a direct constant tautness of the thumb stall, and an independent control of tautness across the palm. The strap or straps which have a fastening means at the free end may include elastic means. Various types of fastenings which may be used in various constructions of the strap and or elastic combination are disclosed.

6 Claims, 37 Drawing Figures

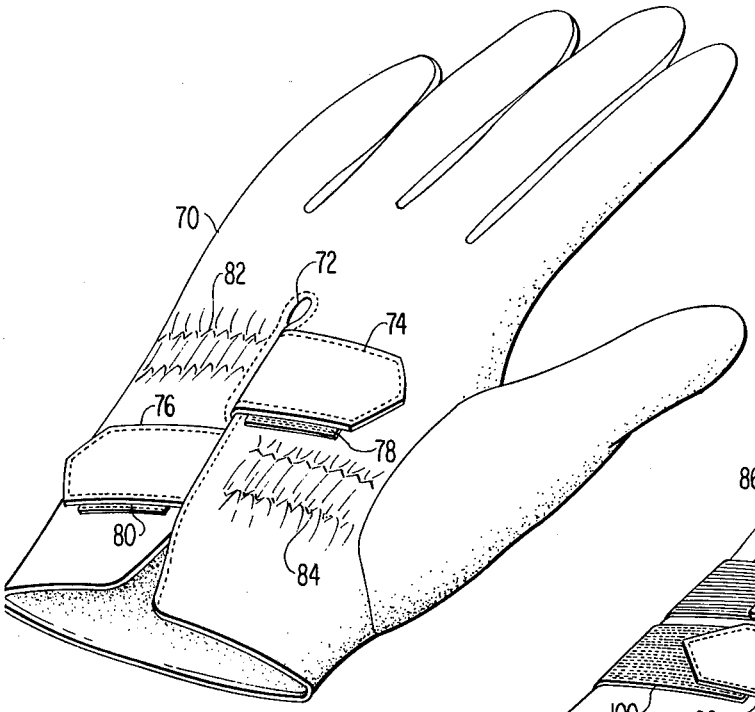
FIG.6
FIG.7
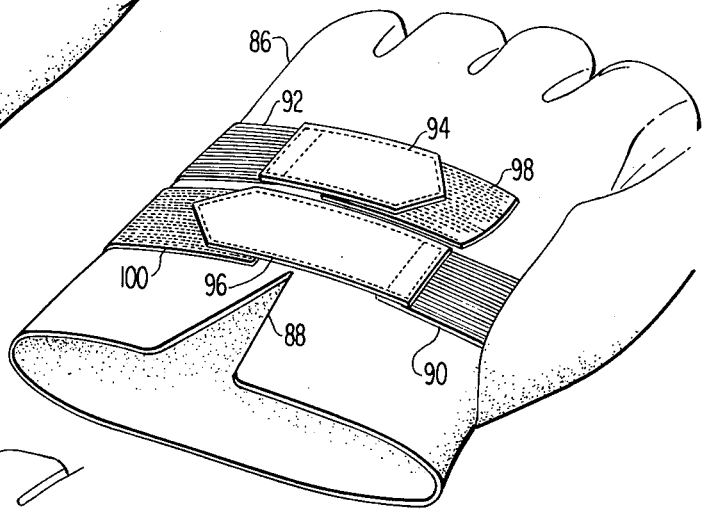
FIG.8
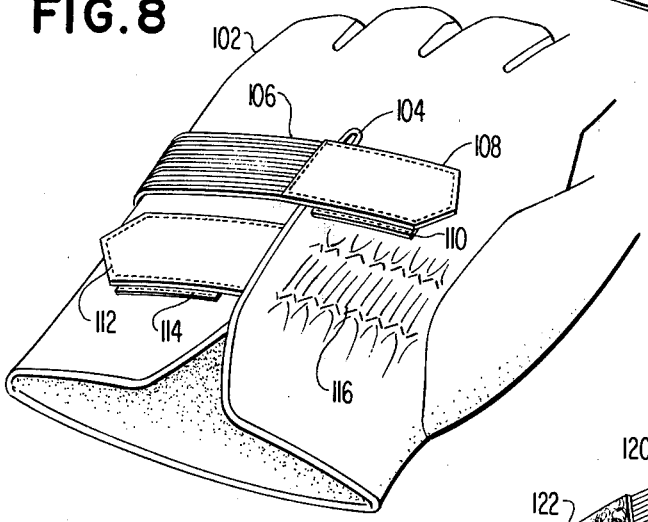
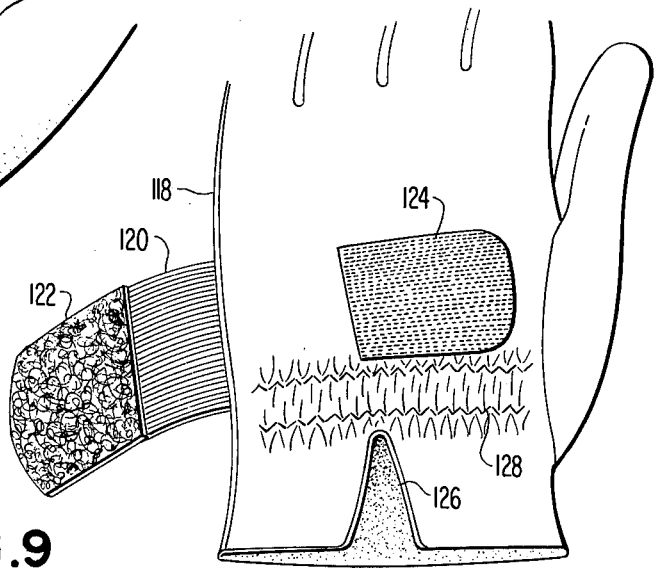
FIG.9

FIG. 10
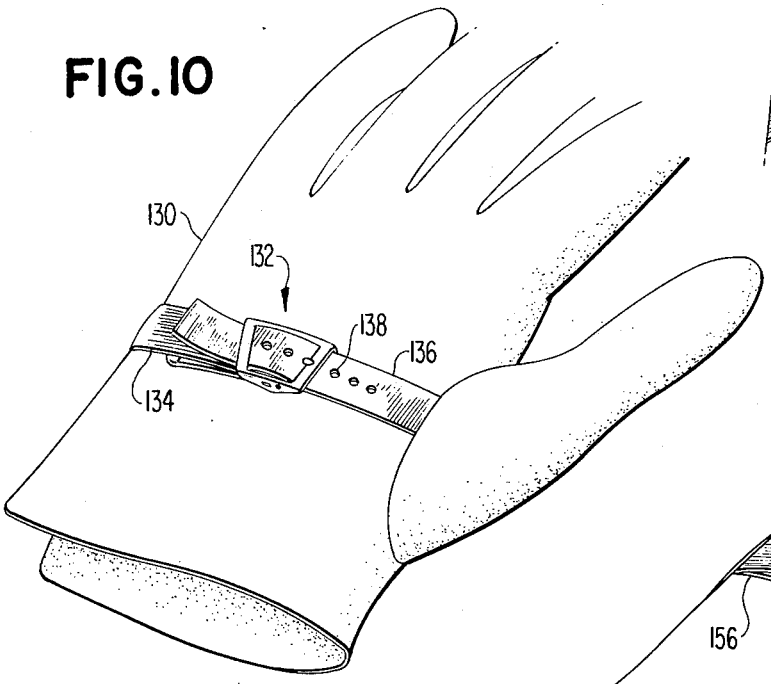
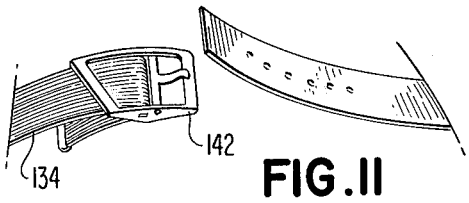
FIG. 11
FIG. 12
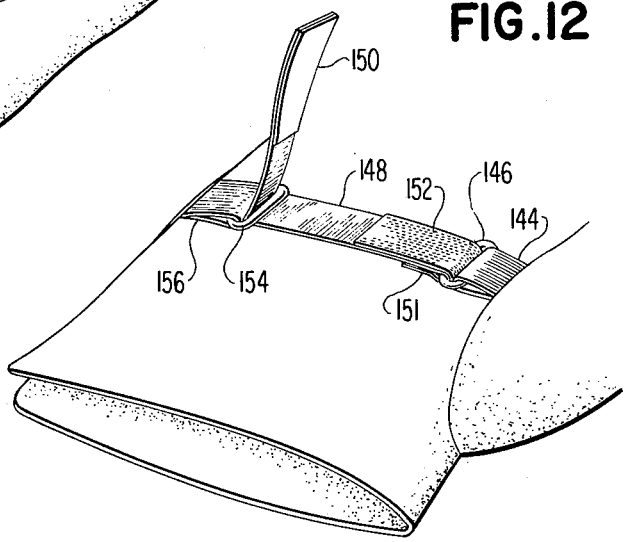
FIG. 14
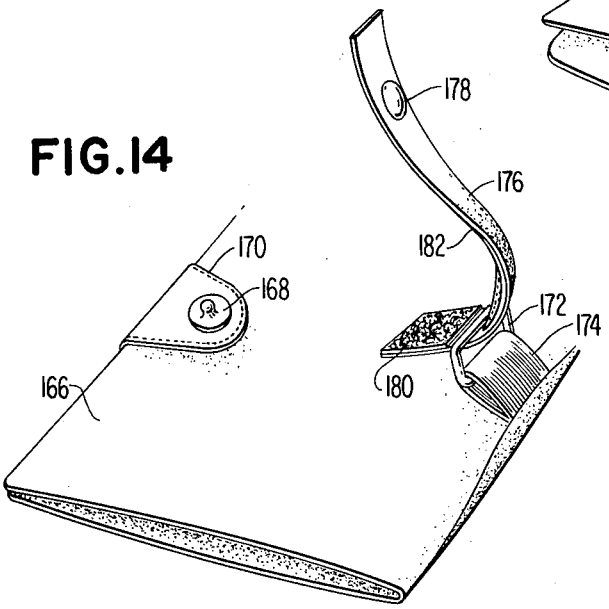
FIG. 13
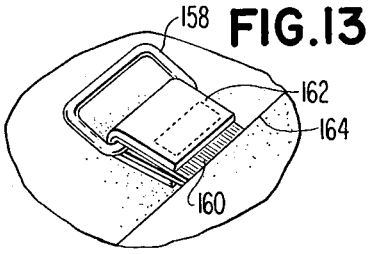
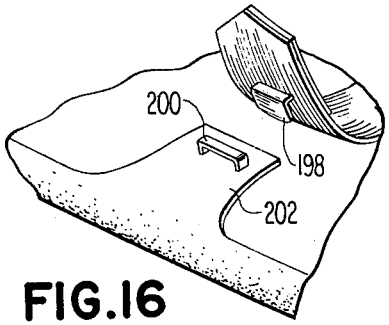
FIG. 16
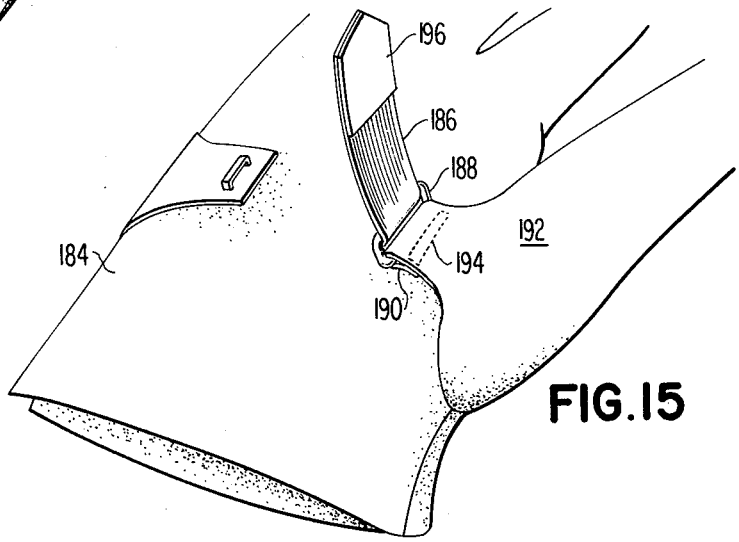
FIG. 15

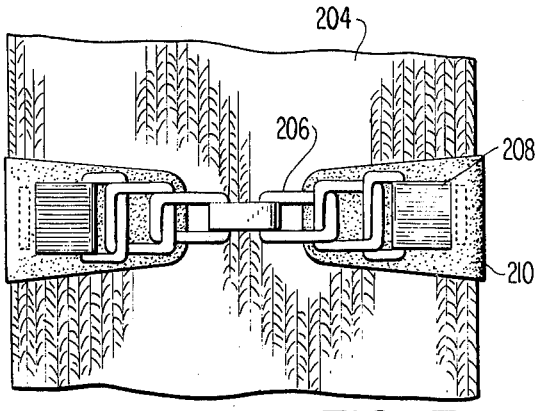
FIG.17
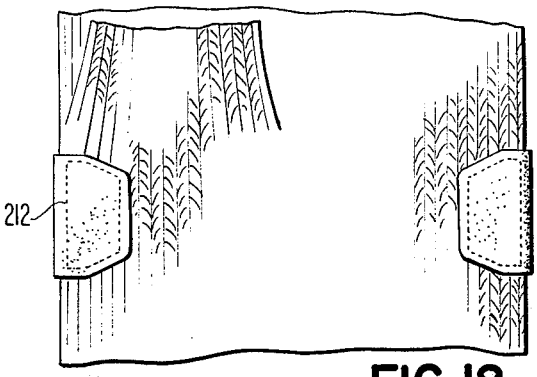
FIG.18
FIG.20
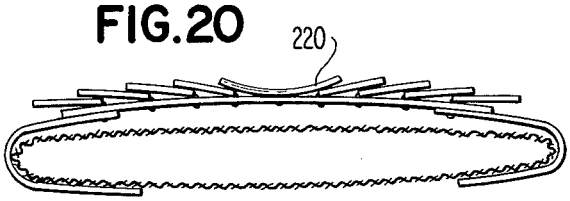
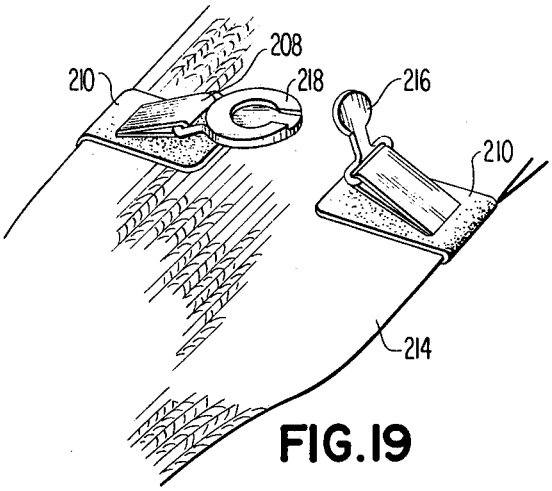
FIG.19
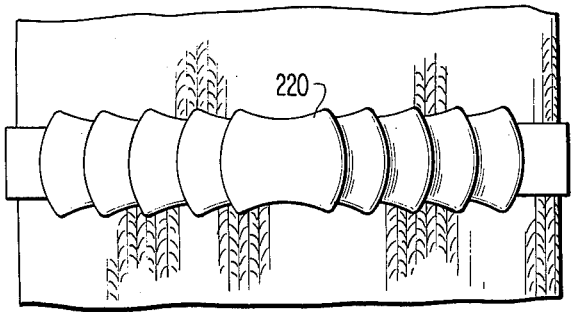
FIG.21
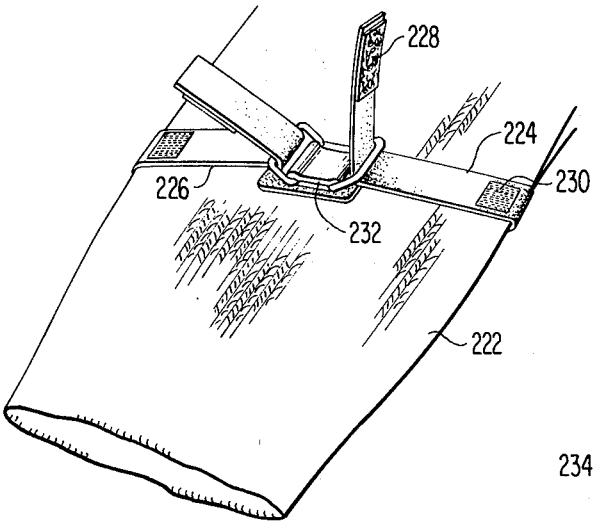
FIG.22
FIG.23
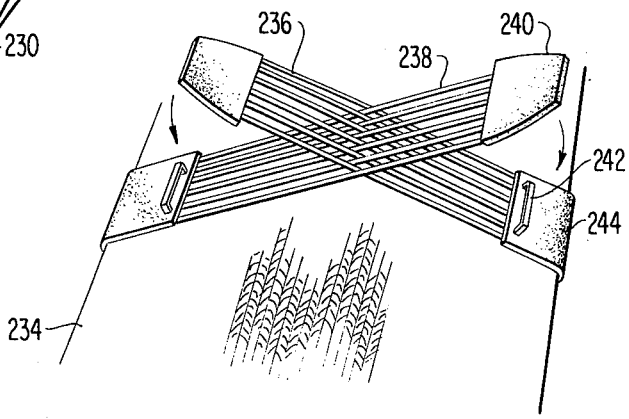

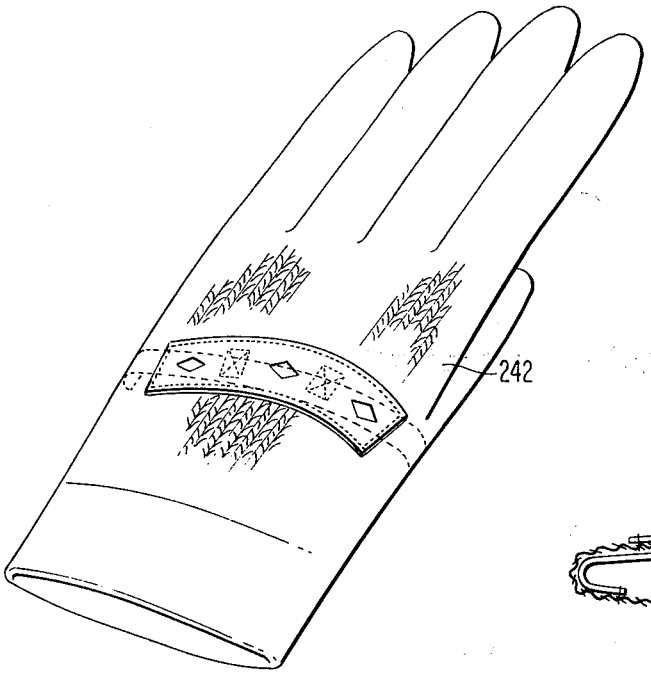
FIG.24
FIG.25
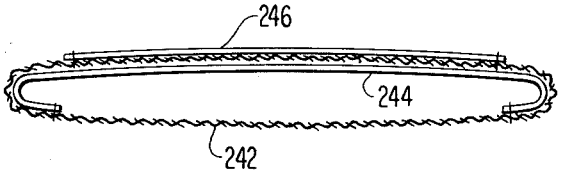
FIG.26
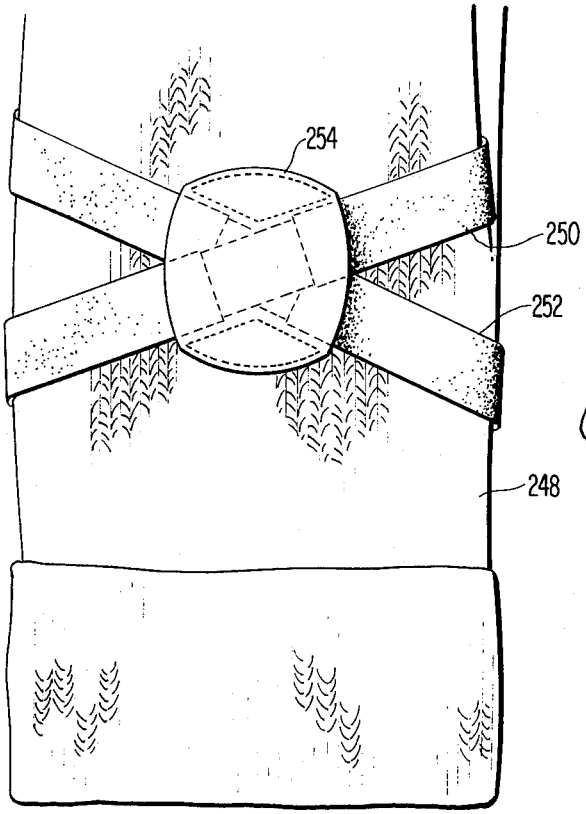
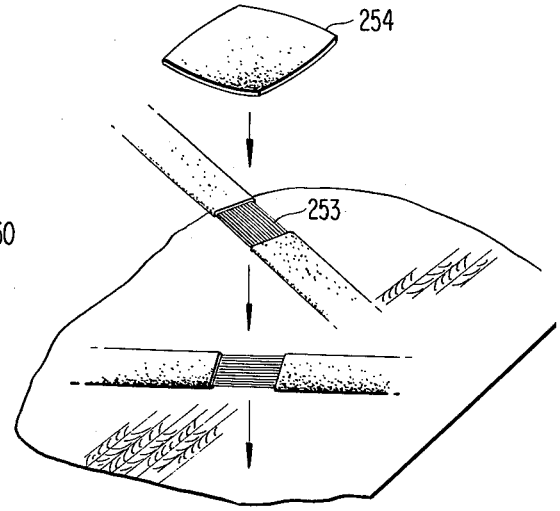
FIG.27

FIG.28
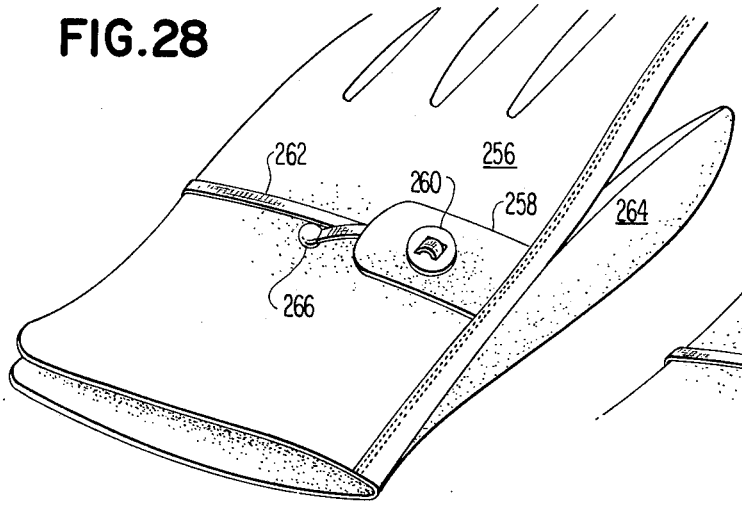
FIG.29
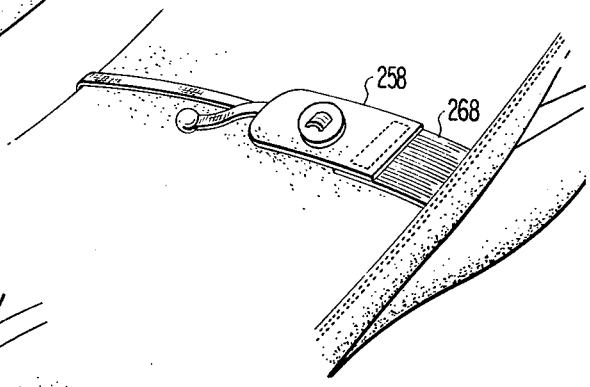
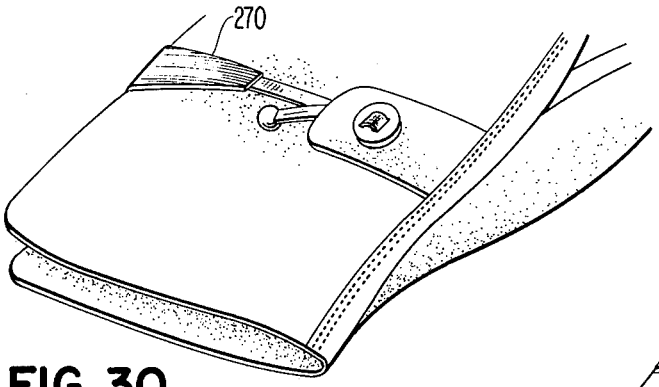
FIG.30
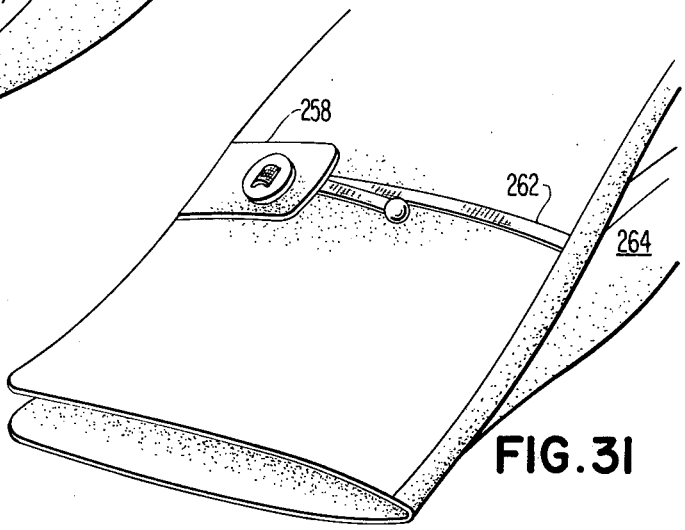
FIG.31
FIG.32
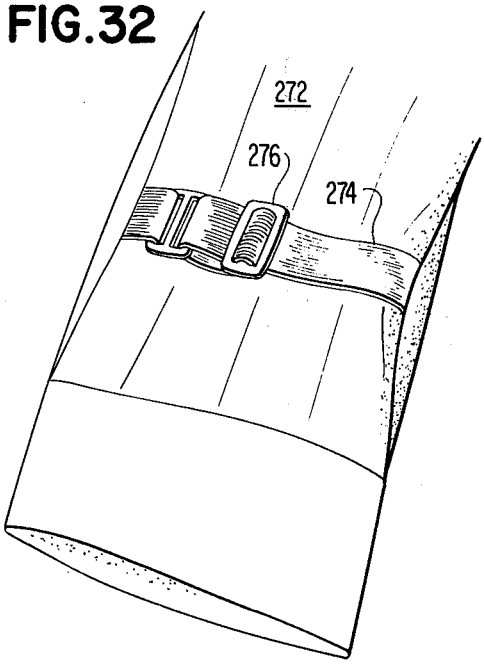
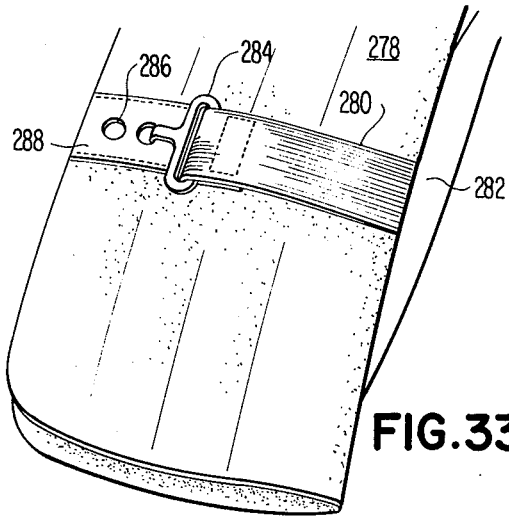
FIG.33

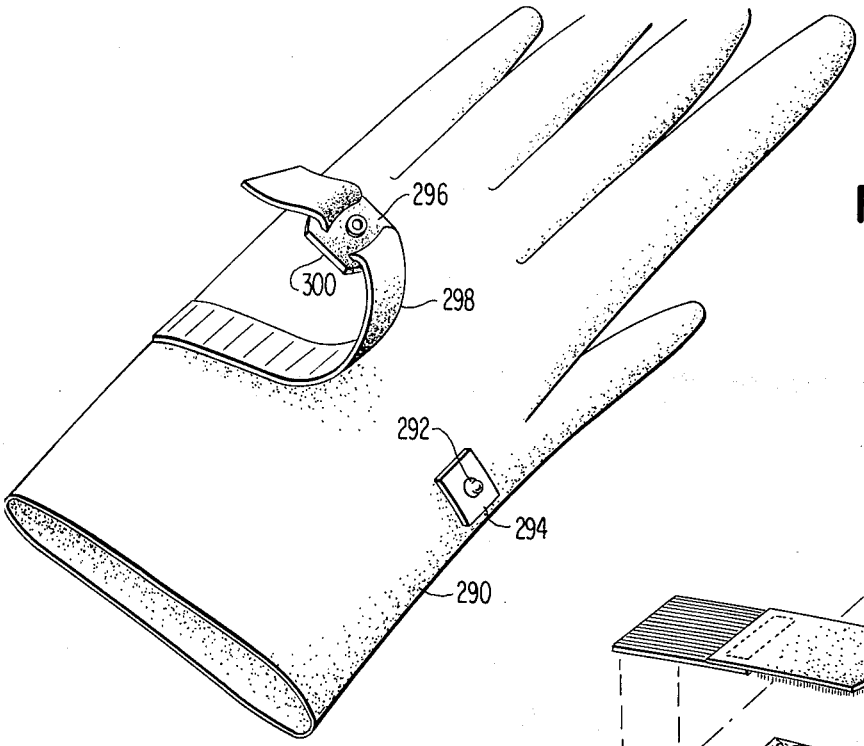
FIG.34
FIG.35
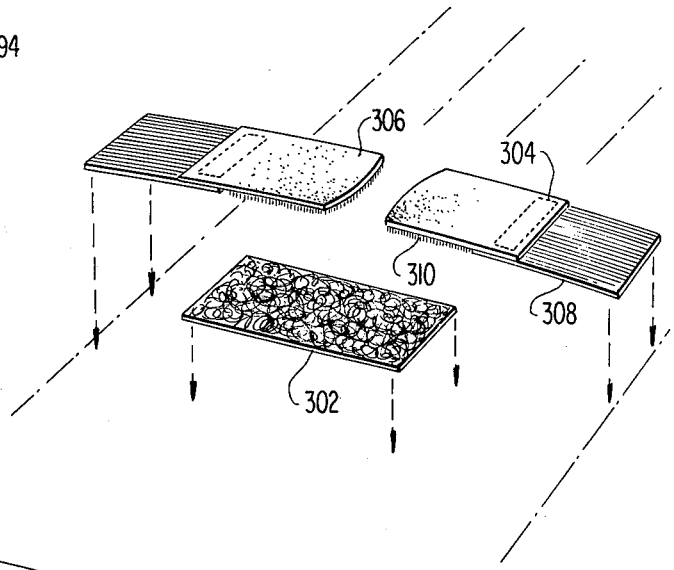
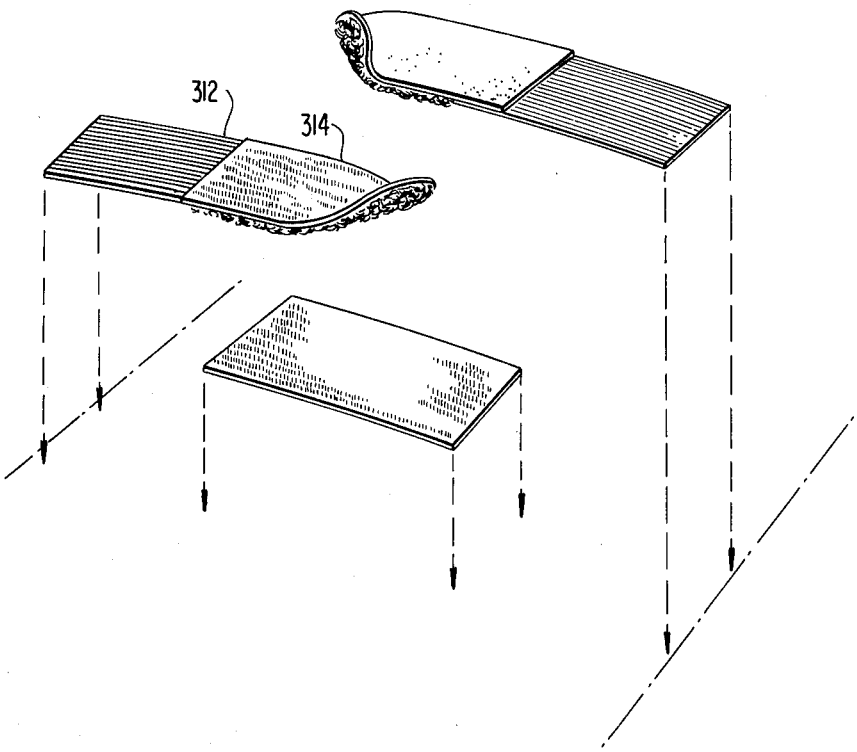
FIG.36

GLOVE

BACKGROUND OF THE INVENTION

1. Field of the Invention

This invention relates to improvements in the art of gloves.

2. Description of the Prior Art

In my prior U.S. Pat. No. 3,588,917, I disclosed a number of means of maintaining a taut fit of the glove cross the palm of the hand by virtue of various constructions. This glove of my prior patent does not, however, permit the material of the thunb to be fully pulled tautly down and also the material across the palm to be pulled taut, in unison. In many athletic activities such as tennis, golf and the like, the glove is worn on the hand gripping the athletic implement such as a golf club or tennis racket. In such sports the thumb is usually the controlling finger and loose fitting or excess material on the thumb of the glove especially at the end thereof can adversely affect play of he game for the user. Therefore, it is highly desirable and the use of my glove has proved highly beneficial in such games because it holds the material comprising the thumb stall taut, while also holding the material comprising the palm of the glove taut.

SUMMARY OF THE INVENTION

This invention relates to a glove which can be used for athletic activities or for a work glove in which means are provided for pulling the glove taut along the thumb stall to maintain the material of the thumb stall taut on the thumb and also pull the glove taut across the palm by unique means positioned on the back surface of the glove.

BRIEF DESCRIPTION OF THE DRAWINGS

FIG. 6 is a persepctive view of the back side of a glove of utilizing twin tabs.

FIG. 7 is a perspective view of the back side of the glove utilizing twin straps.

FIG. 8 is a back view of the glove utilizing a strap and a tab.

FIG. 9 is a perspective view of the back of a glove utilizing a wide strap and thumb elastic.

FIG. 10 is a perspective view of the back of a glove utilizing a buckle strap.

FIG. 11 is a detail of the strap fastener of FIG. 10.

FIG. 12 is a perspective view of the back of the glove utilizing a pull strap pulled through a strap or ring.

FIG. 13 is a perspective view of the modification of the anchor shown in FIG. 12.

FIG. 14 is the perspective view of the back of the glove using a strap and a button snap.

FIG. 15 is the perspective view of the back of a glove with a strap and hook.

FIG. 16 is a detailed fragmentary perspective view of the hook.

FIG. 17 is a plan view of a strap across the back of a glove.

FIG. 18 is a view of the underside of a glove with the strap feature.

FIG. 19 is a perspective view of a segmented strap with ends attached at opposite sides of the glove.

FIG. 20 is a sectional view of a continuous strap.

FIG. 21 is a top plan view of the strap shown in FIG. 20.

FIG. 22 is a perspective view of twin straps pulled through loops positioned in the center of a glove.

FIG. 23 is a perspective view of twin straps with hooks.

FIG. 24 is a perspective view of leather-like, elastic or elastic material utilized as a strap across the back of a glove. This strap may consist of flexible or rigid material or ornament and may also be used in combination with elastic means which may be attached on the top of or on the underside of the glove.

FIG. 25 is a sectional view of FIG. 24.

FIG. 26 is a plan view of a stretchable material glove back utilizing a plurality of straps incorporating elastic means, which are attached at opposite sides of the glove.

FIG. 27 is an expaned view of FIG. 26.

FIG. 28 is a perspective view of another pull type lace or strap with adjustable means for a work or sports glove.

FIG. 29 is a perspective view of a modification of FIG. 28 utilizing elastic.

FIGS. 30 and 31 are other modifications in perspective view of the glove of FIG. 28.

FIG. 32 is a perspective view of the back of a glove utilizing a strap or elastic with adjustable sliding buckle to make the glove taut.

FIG. 33 is a perspective view of the back of a glove showing a further design strap utilizing a hook type fastener with elastic means.

FIG. 34 is a perspective view of the back of a rubber glove utilizing a strap wih adjustable sliding type snap fastening means.

FIG. 35 is a perspective view showing the use of twin flexible straps attached to opposite sides with complimentary fastening means located on back of the glove.

FIG. 36 is a perspective view similar to FIG. 35 except it shows the use of velcro on straps which fasten by an overlapping method when aligned with complimentary fastening means on back of the hand.

BRIEF DESCRIPTION OF THE PREFERRED EMBODIMENTS

Figure 1:
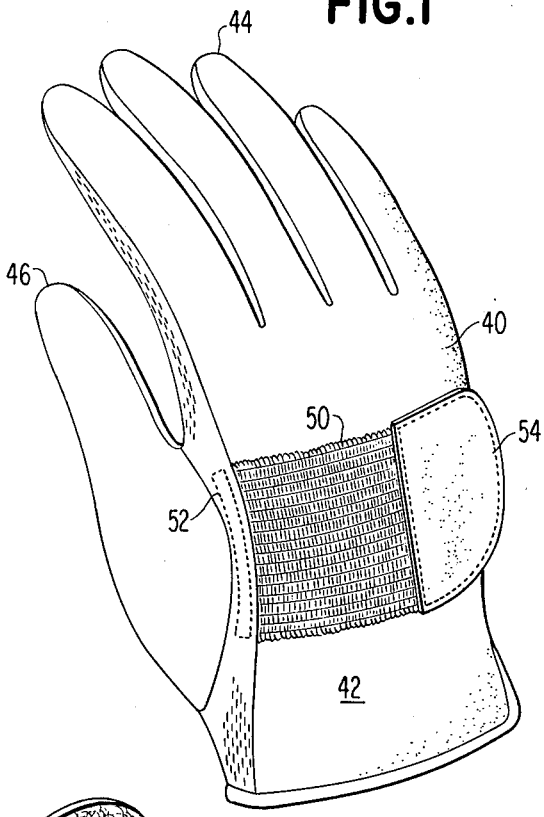
FIGS. 1–5 are various views of a tennis glove incorporating the features of this invention.
Figure 2:
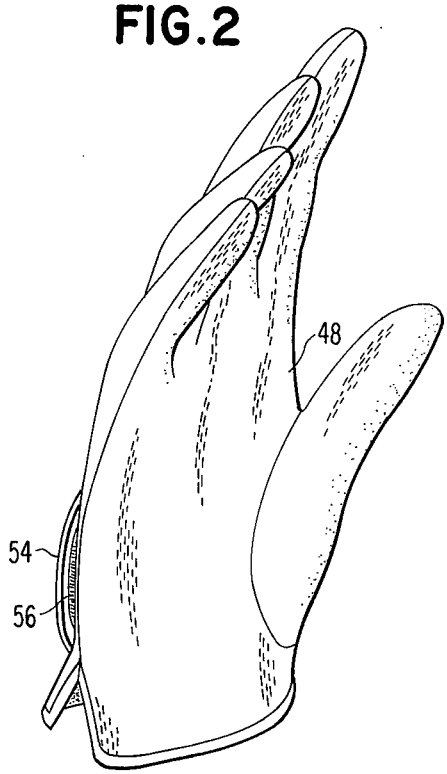

The tennis glove 40 shown in FIG. 1 includes a back portion 42 of cloth mesh or the like, including leather, terry cloth, and various other suitable resilient stretchable materials. Finger stalls 44, a thumb stall 46 and a palm portion 48 are of non-slip material.

Figure 3A:
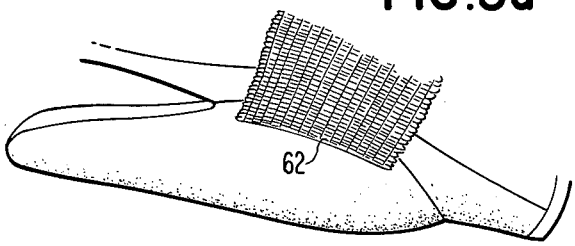
Figure 4:
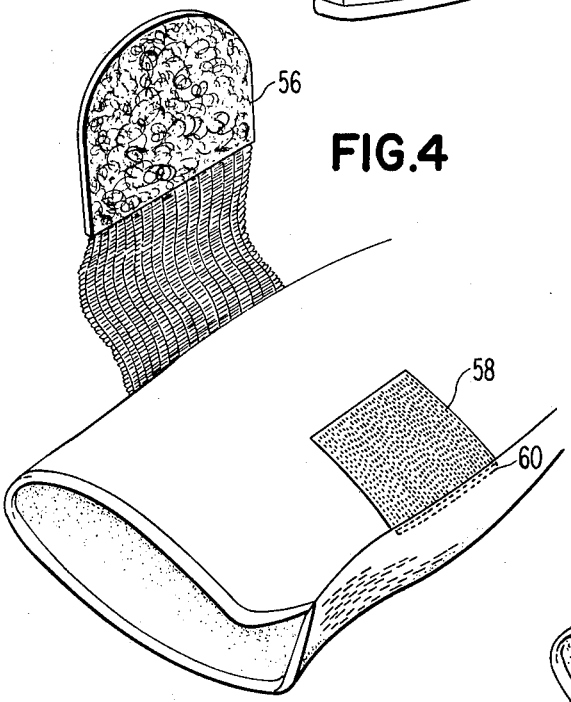
Figure 5:
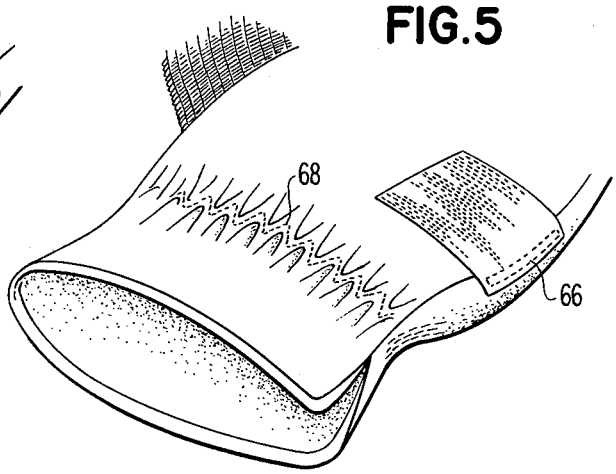
Figure 3B:
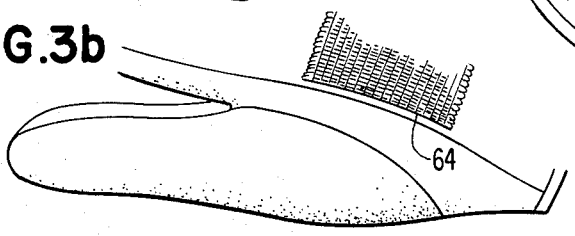

This invention provides a means for maintaining tautness in the thumb by a strap 50 which may be elastic or the like which strap is secured to the glove fabric or reinforcing at 52 adjacent the base of the thumb stall. The elastic strap allows flexing for greater tension or pulling force with comfort to the wearer's hand. The strap incorporates a tab 54 at the free end which may have a velcro undersurface as shown in FIG. 4 or attachment to a mating velcro pad 58 sewn in the seam 60 as shown in FIG. 4, for example. Any number of strap fastening means may be utilized for the free end strap such as hook and loop, snaps, hooks, buckles and the like. As shown in FIG. 3A the strap may be sewn onto the outside of the thumb stall as at 62 and as shown in FIG. 3B may be sewn inside the seam on the back surface of the glove at 64. FIG. 5 shows the velcro pad sewn to the palm portion of the glove as at 66 and additionally shows an elastic gathering material 68 sewn to the inside of the glove adjacent the wrist. An additional gathering material may, if desired, be sewn in the glove above the strap 50.

The gripping surface 48 may be impregnated with non-slip material or be fabricated of non-slip material for better, more responsive gripping and longer glove life. The glove may be made of conventional glove material such as leather, cotton, wool, nylon or the like.

The existing gloves known to me do not incorporate the arrangement of this glove for directly controlling the tautness of the thumb stall to eliminate or greatly minimize thumb droop or excess material that hangs beyond the thumb. This excess material is not only annoying, causing the thumb to be stretched out of shape or baloon but it causes the thumb to slip and twist when the wearer applies a gripping force with the thumb, for example, to a tennis racket. This feature is also useful in golfing gloves as it is crucial to the golfer who must maintain a firm solid contact on the club with the thumb of his gripping hand. Excess thumb stall material and thumb droop causes the thumb to roll or slip forward or backwards which will destroy the accuracy and effectivenes of the stroke of the implement grip by the gloved hand.

FIG. 6 illustrates the twin tab double action principal as applied to a golf glove. One tab is utilized to create tension or pulling force on the palm and the other tab to create tension and pulling force on the thumb to maintain overall tautness and fit. In this embodiment a glove 70 of otherwise ordinary construction has a deep vent 72 extending above the top of the thumb stall gouge and has a pair of tabs 74 and 76 which mate with respective velcro pads 78 and 80. The tabs extend in opposite directions and linerally aligned with the tabs are elastic strips 82 and 84 sewn into the glove to provide elastic gathering and tension. As can be seen, this arrangement creates opposite forces across the back of the glove and the lower tab 76 and its line of elastic 84 are directly in line with the lower center line of the thumb stall to obtain maximum overall tautness on the thumb while the upper tab maintains overall tautness across the palm area in back of the hand. The lower palm area has tension applied directly by the lower tab.

FIG. 7 illustrates an embodiment of my invention utilizing a twin strap double action principal. In this modification, a glove 86 has a shallow vent 88 in the back and a pair of straps 90 and 92 which extend in opposite directions from opposite sides of the back of the glove. The straps have end tabs 94 and 96 which mate with corresponding velcro pads 98 and 100. With the glove of FIG. 7, the upper strap 92 controls the force for maximum tautness to the upper palm area and the upper back of the hand, while the lower strap controls direct pulling for maximum tautness of the thumb stall, the lower palm area and the lower back of the hand.

FIG. 8 illustrates a glove similar to FIG. 6, utilizing a combination of one tab and one strap. In this embodiment glove 102 has a deep vent 104 and one strap 106 with a free end tab 108 with a velcro fastening means on the underside mating with a velcro pad 110. A tab 112 extends below the strap in an opposite direction and is secured by a velcro pad 114. Elastic 116 is sewn into the glove in alignment with the tab 112 adjacent the thumb stall. The strap 106 controls the direct tension force for the upper palm and the upper back of the hand and the tab 112 controls the direct tension force for pulling back the thumb stall in the lower palm area in the lower back of the hand next to the wrist.

The embodiment of FIG. 9 shows the construction of the back of a glove which is different from FIGS. 6, 7 and 8, but accomplishes the same as the embodiments of FIGS. 6, 7 and 8. In this embodiment, a glove 118 has a strap 120 of elastic or the like with velcro tab 122 on its free end mating with a velcro pad 124 sewn to the back of the glove. There is a shallow vent 126 and a strip of elastic 128 sewn across the bottom of the glove between the strap and adjacent the thumb stall. The strap 120 is quite wide to control the wide portion of the palm and upper back of the glove and the elastic means 128 provide substantial tension across the back of the hand in connection with the thumb keeping the thumb stall taut.

FIG. 10 is another embodiment showing the use of a buckle strap across the back of the glove to maintain the thumb stall taut. In this case the glove utilizes a strap 132 across the back. This strap has a buckle portion 134 which may be elastic attached to the side portion of the glove and an adjustable tab portion 136 with the holes 138 attached to the thumb portion of the glove. The buckle portion 134 may itself be adjustable by having the strap 132 going through a loop 140 in a buckle 142. The strap ends are attached to the opposite sides of the glove either in the butt or thumb gouge seams or back of the glove between the seams or on the other side of the seams. This arrangement allows controlling of the tension by a pulling force directly affecting the thumb stall and palm area in the area of the thumb. At the same time the tension pulling force is exerted to the palm on the opposite side fo the glove. The strap itself may be lengthened or shortened as desired by the wearer.

FIG. 11 is a detail of FIG. 10 showing a portion 134 which is both elastic and adjustable lengthwise for correct position of buckle 142.

FIG. 12 shows an embodiment which utilizes a strap 148 pulled through a ring 154 to maintain the thumb stall taut. One end of strap 148 consists of elastic means 144 and which anchor loop 146 and 156 at opposite ends of the glove. Strap 148 may include a button snap fastener, hook, or velcro tab 150 on the underside of the free end for mating with complimentary button snap, hook or velcro pad portion 152 as shown in FIG. 12.

Alternatively, the entire strap may be made of non-elastic, or elastic, or elasticized material. The strap may be shortened or lengthened using velcro pad 151. This arrangement is the same as that shown in FIG. 10.

FIG. 13 is a detailed view showing how a loop 158 may be secured by elastic 160 and leather-like material 162 directly to a seam 164.

FIG. 14 shows another embodiment utilizing a strap and button snap. In this embodiment a glove 166 has a button snap male portion 168 on a tab 170 attached to on side of the glove and a ring 172 secured to a loop 174 attached to the other side of the glove. The strap 176 has a female snap 178 in one end thereof for mating with snap 168 and has a velcro pad 180 on its free end for mating with a velcro surface 182 on the underside for adjustment of length of the strap. This is particularly useful in a dress glove in which the snap may be adjustable to its permanent position.

FIG. 15 illustrates an embodiment in which for FIGS. 15 and 16, there is a hook arrangement for securing the strap. As shown in FIG. 15, a glove of 184 has a strap 186 of elastic or the like which is attached to a ring or loop 188. Also the loop is further secured to material 190 extending from the thumb stall 192 secured by stitching 194 or the like. At the free end of the strap 186 is a tab 196 having a hook 198 on its undersurface for mating with an eye 200 attached to a portion 202 of the other side of the glove as shown in FIG. 16.

FIG. 17 shows the invention as applied to a knit glove or the like in which a glove 204 has a flexible but inextensible material such as chain or linked means 206 attached to elastic portions 208 which in turn are attached to reinforced portions 210 to create tension or pulling force to make the glove fit and feel better because of greater snugness. This modification is not only useful for knitted gloves but also elasticized or mesh material gloves. The strap may be attached at various points across the back surface of the glove and the elastic 208 to have varying degrees of tension. The material 210 may also be sewn partially across the palm of the glove as shown in FIG. 18 at 212. An additional elastic means may be included in the chain 206.

FIG. 19 shows a segmented strap of the general hook and eye type applied to a mesh glove 214 in which there are the leather-like tabs 210 sewn to the glove elastic loops 208 and a hook and eye 216, 218.

FIGS. 20 and 21 show a continuous strap secured to opposite ends of the glove and the strap 220 may be segmented.

FIG. 22 shows another modification for a knit glove 222 in which there are a pair of straps 224 and 226 with their one end of each strap attached to a portion of the glove the free ends having velcro portions 228 mating with velcro pad portions 230 after passing through a double ring member 232. This allows the wearer to adjust for different tautness on opposite sides of the glove as desired.

A similar arrangement allowing adjustment for tautness on opposite sides of the glove is shown in FIG. 23 wherein a glove 234 of knit or the like has a pair of straps 236 and 238 of resilient spaced band material which are interweaved as shown in FIG. 23 with hooks on the tabs 240 and not shown for mating with eyes 242 on the portions 244 anchored to the sides of the glove.

FIGS. 24 and 25 illustrate a modification of a knit glove 242 with means across the back to prevent it from stretching including an inside or outside elastic means 244 and an outside strap leather-like or ornamental 246 which may be part of the strap or attached to the glove material. Although the remaining portion of the glove can stretch, the portion across the back of the palm cannot, thus creating tension or pulling force for greater snugness.

FIGS. 26 and 27 show another arrangement for providing the back of knit or mesh gloves wit a tension force for a better fit and feel, attributable to more snugness. In this modification, the glove 248 has a pair of diagonally spaced straps 250 and 252 which may have stretchable or non-stretchable material extending as shown in FIG. 26 and a center cap secured 254 which operates as shown in FIG. 27. The straps may include additional elastic means as shown, and may be attached to opposite sides of the glove, not shown.

FIGS. 28–30 show modifications in this invention as applied to a work glove and utilizing a cinch type fastener. In this modification the work glove 256 of leather or the like, has a leather tab 258 which includes a cinch type fastener 260 for cinching or holding a strap 262 to whatever adjusted tautness is desired. In other words, the cinching strap is known but they have never been mounted adjacent the side of the thumb stall 264. One end of the strap is anchored at the side of the glove and the strap has a ball 266 on its free end.

As shown in FIG. 29 the portions 258 may have an elastic 268 interposed between its base and the edge of the glove adjacent the thumb stall 264 for greater comfort when flexing. This modification of portion 258 with elastic 268 may be positioned at the opposite side of the glove, the butt area of palm, like shown in FIG. 31.

The FIG. 30 modifications show elastic 270 at the end of the strap 262 which is attached to the side of the glove.

FIG. 31 shows the parts including the cinch strap and the tab reversed from that shown in FIG. 28 in which the straps 262 is attached at the edge of the thumb stall 264 and the cinch support 258 is attached to the other side of the glove.

In these embodiments, when the lace, through the cinch grommet is pulled upwardly it draws endwardly on the ends of the gloves to create the desired tautness across the palm and back for better overall fit and feel. To release tension slight pulling upward on the tab with the grommet cinch releases the tautness.

FIG. 32 shows another arrangement for providing tautness across the back of the glove 272 by a strap 274. The strap has an adjustable buckle type member 276 of a type known in the art incorporated therein. Note that one side is attached adjacent the thumb stall. And like the other gloves the strap ends may be attached in the seams, palm areas or adjacent the seams on the back side of the gloves.

FIG. 33 shows another glove 278 utilizing a strap 280 having one end attached adjacent the thumb 282 on one side and a hook 284 for insertion into holes 286 on a tab 288 attached to the other side of the glove.

FIG. 34 shows the teachings of this invention applied to a rubber glove 290. In this case a male snap fastener 292 on a pad 294 secured to the glove cooperates with the female fastener 296 on the end of a rubber strap 298 which is adjustable through the grommet 300 to allow lengthening or shortening of the strap to the desired tautness.

FIGS. 35 and 36 show additional designs of straps for attachment across the back of the hand for a glove. In FIG. 35 there is a velcro pad 302 and a pair of straps 304, 306. Each strap may include elastic portions 308 and a complimentary velcro portion 310 so that with the single velcro base 302 there may be pulling from opposite sides of the glove secured to the pad 302.

FIG. 36 is similar to FIG. 35 only the left hand tab 312 has velcro 314 on its upper face, which allows securing of the glove by the overlap method.

What is claimed is:

1. In a glove comprising a flexible body with a palm portion, a back portion covering the entire back of the hand, finger stalls, and a thumb stall, the improvement comprising:

a. a first elastic means secured to the glove fabric at or in proximity to the base of the thumb stall;

b. a first tab attached directly to the first elastic means at the end thereof remote from the thumb stall and having a hook and pile fastener undersurface; and c. a mating hook and pile fastener surface on the glove in position to unite with the hook and pile fastener undersurface on the first tab when the first elastic means is stretched, whereby, when the first elastic means is stretched and the hook and pile fastener surfaces are united, the thumb stall is maintained taut and thumb droop is prevented.

2. A glove as recited in claim 1 wherein said first elastic means is an elastic strap.

3. A glove as recited in claim 1 wherein said first elastic means is an elastic strip sewn into the glove to provide elastic gathering and tension.

4. In a glove as recited in claim 1, the further improvement comprising:

a. a second elastic means secured to the glove fabric on the side of the glove remote from the thumb stall and nearer to the finger stalls than the first elastic means;

b. a second tab secured to the second elastic means at the end thereof adjacent to the thumb stall and having hook and pile fastener undersurface; and c. a mating hook and pile fastener undersurface on the glove in position to unite with the hook and pile fastener undersurface on the second tab when the second elastic means is stretched, whereby, when the seond elastic means is stretched and the Velcro surfaces are united, the palm of the glove is maintained taut.

5. A glove as recited in claim 4 wherein said second elastic means is an elastic strap.

6. A glove as recited in claim 4 wherein said second elastic means is an elastic strip sewn into the glove to provide elastic gathering and tension.

* * * * *